United States Patent [19]

Mullen et al.

[11] Patent Number: 4,992,070

[45] Date of Patent: Feb. 12, 1991

[54] FINGER ACTUATED TOY FIGURE

[76] Inventors: Charles F. Mullen, 204 Yacht Club La., Seabrook, Tex. 77586; Daniel C. Mullen, 243 W. Mount Royal La., Milwaukee, Wis. 52317

[21] Appl. No.: 858,810

[22] Filed: May 2, 1986

[51] Int. Cl.[5] ..... A63H 3/20

[52] U.S. Cl. ..... 446/359; 446/367; 446/327

[58] Field of Search ..... 446/327, 367, 359, 329; 63/15; 24/546, 551

[56] References Cited

U.S. PATENT DOCUMENTS

| | | | |
|---|---|---|---|
| 2,484,449 | 10/1949 | Fetterman | 24/551 X |
| 2,530,610 | 11/1950 | Genone | 446/327 X |
| 2,551,195 | 5/1951 | Wirth | 446/327 |
| 2,624,155 | 1/1953 | Boyce | 446/367 |
| 3,805,549 | 4/1974 | Nielsen | 63/15 X |
| 4,148,151 | 4/1979 | Ulrich | 446/367 |
| 4,643,694 | 2/1987 | Phibbs | 446/327 |
| 4,654,018 | 3/1987 | Farrington et al. | 446/327 X |

FOREIGN PATENT DOCUMENTS

| | | | |
|---|---|---|---|
| 337132 | 5/1921 | Fed. Rep. of Germany | 446/327 |

*Primary Examiner*—Mickey Yu

*Attorney, Agent, or Firm*—Kenneth A. Roddy

[57] ABSTRACT

Am improved manipulative articulated toy figure has rings attached to certain movable limbs and is operated by the fingers of a human hand for reproducing lifelike human or animal movement. The figure has a central body portion and a plurality of limbs movably mounted thereto. The rings extend outwardly from the limbs and each receives a human finger for independent manipulation of the limbs to control the movements of the articulated figure. The rings allow the figure to be selectively used as a conventional articulated toy figure or as a finger actuated puppet figure.

8 Claims, 1 Drawing Sheet

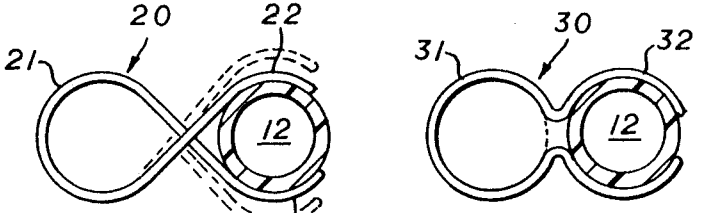
fig.3
fig.4
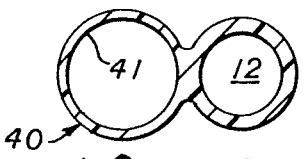
fig.5
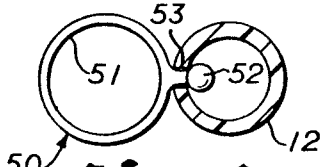
fig.6
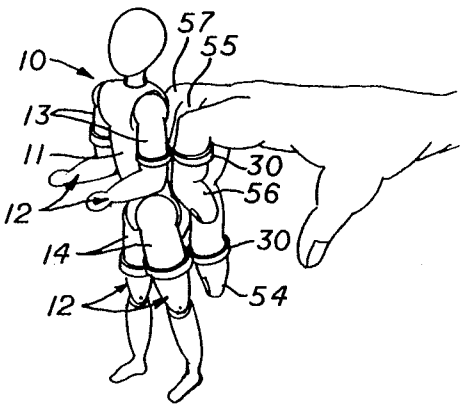
fig.7
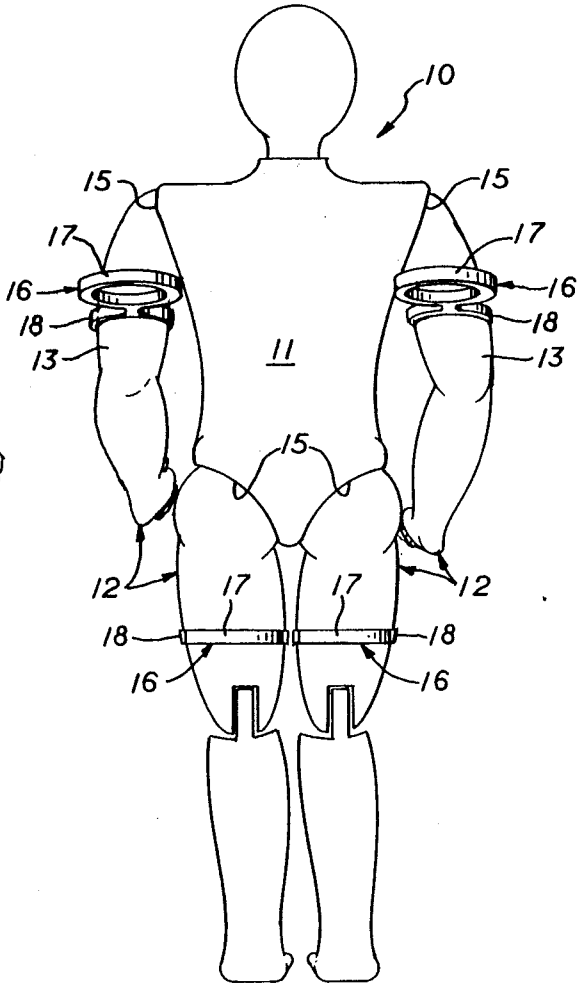
fig.2
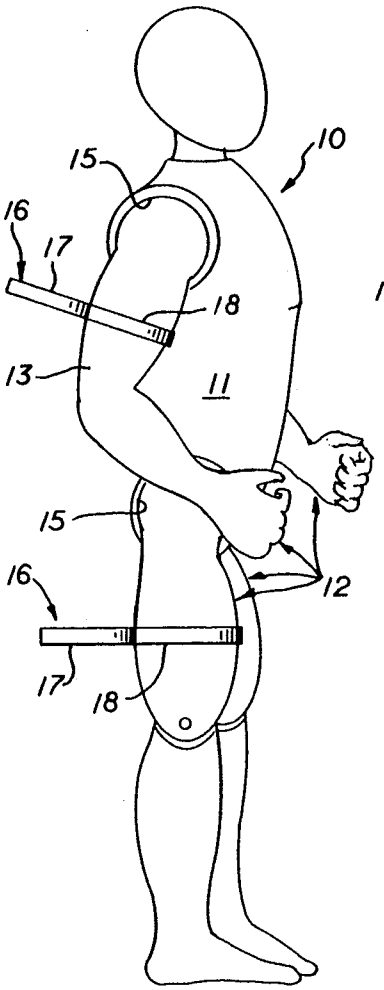
fig.1

FINGER ACTUATED TOY FIGURE

BACKGROUND OF THE INVENTION

1. Field of the Invention

This invention relates generally to puppets and manipulative articulated toy figures, and more particularly to an improved articulated toy figure having rings on the limbs to receive the fingers of a human hand for reproducing lifelike human or animal movement while being operated by the fingers.

2. Brief Description of the Prior Art

Leeper, U.S. Pat. No. 2,155,665 discloses a small hollow puppet construction whereby a plurality of the puppets may be mounted separately on different fingers.

Noble et al, U.S. Pat. No. 3,613,301 discloses a puppet-like figurine having a rigid upper body or torso and a removable elastic fabric lower body forming hollow legs. The fabric includes a garment open at the back for insertion of two of the child's fingers into the hollow legs. An elastic loop is secured on the flat back of the figure between the shoulders to hold at least one finger directly against the back of the upper body to support the torso upright.

Enison, U.S. Pat. No. 2,801,495 discloses a hand puppet having a hollow head with a moveable lower jaw and a hollow flexible costume attached to the head. A pull ring and anchor ring are attached at one end of a cable and the other end of the cable is connected to pivotally move the jaw.

Goldfarb, U.S. Pat. No. 3,820,276 discloses a pellet filled doll which may be used as a doll or hand puppet. The body has a compartment for receiving the hand of the user.

Rushton, U.S. Pat. No. 3,942,283 discloses a hand puppet shaped like a stuffed toy and a body cavity for receiving the hand and five fingers of the operator for manipulation by five fingers.

Rogers, U.S. Pat. No. 4,276,715 discloses a puppet having in combination an elongated support pole, an eye part attached at one end of the pole, a glove having five fingers including at least a pair of fingers straddling the pole for up and down and rotation of the pole and a flexible mouth part mounted at the ends of the five fingers and for retaining the pole.

Baiera, U.S. Pat. No. 4,304,065 discloses a glove-like hand puppet in the figure of an animal having a body cavity and finger receiving cavities whereby the hand and fingers of the operator are inserted into the glove and the puppet manipulated in simulation of body carrying movement.

A line of soft action figures was introduced in 1985 by Coleco Industries, Inc. The figures are relatively large flying or crawling insect forms having a furry glove-like enclosure built into the figure which allows the child to control the movement of the figure. The limbs or appendages of the figures do not use rings which receive the fingers of the operator.

The present invention is distinguished over the prior art in general, and these patents in particular by an improved manipulative articulated toy figure which may be selectively used as an ordinary articulated figure or operated by the fingers of a human hand for reproducing lifelike human or animal movement. The figure has a central body portion and a plurality of limbs movably mounted thereto. A ring is attached to certain ones of the limbs to extend outwardly therefrom and each receives a human finger for independent manipulation of the limbs to control the movements of the articulated figure.

SUMMARY OF THE INVENTION

It is therefore an object of the present invention to provide an articulated toy figure having rings attached to the limbs for receiving the fingers of a child and allowing the child to control the movement of the figure to reproduce lifelike human or animal movement.

It is another object of this invention to provide a ring clip which may be releasably attached to a conventional articulated toy figure for receiving the fingers of a child and thereby converting it to an articulated toy figure controlled by the child's finger movements.

Another object of this invention is to provide an improved articulated toy figure which will provide more lifelike movements while increasing the manual dexterity of the child manipulating the figure.

Another object of this invention is to provide a means for manipulating articulated toy figures which is simple in design and inexpensive to manufacture.

A further object of this invention is to provide a means for manipulating articulated toy figures which may be incorporated into an established line of toy figures with minimal expense and thereby lending itself to use with licensed characters having established popularity.

Other objects of the invention will become apparent from time to time throughout the specification and claims as hereinafter related.

The above noted objects and other objects of the invention are accomplished by providing an improved manipulative articulated toy figure which may be selectively used as an ordinary articulated figure or operated by the fingers of a human hand for reproducing lifelike human or animal movement. The figure has a central body portion and a plurality of limbs movably mounted thereto. A ring is attached to certain ones of the limbs to extend outwardly therefrom and each receives a human finger for independent manipulation of the limbs to control the movements of the articulated figure.

BRIEF DESCRIPTION OF THE DRAWINGS

FIG. 1 is a side elevation view of an articulated toy figure having rings attached to the limbs in accordance with the present invention.

FIG. 2 is a rear elevation view of the articulated toy figure of FIG. 1.

FIG. 3 is an enlarged transverse cross section view showing a releasable ring clip in accordance with the present invention attached to the limb of an articulated toy figure.

FIG. 4 is an enlarged transverse cross section view showing another ring in accordance with the present invention attached to the limb of an articulated toy figure.

FIG. 5 is an enlarged transverse cross section view showing another ring in accordance with the present invention integral with the limb of an articulated toy figure.

FIG. 6 is an enlarged transverse cross section view showing a ring releasably and pivotally attached to the limb of an articulated toy figure.

FIG. 7 is a perspective view of the articulated toy figure being manipulated by the fingers of a child.

DESCRIPTION OF THE PREFERRED EMBODIMENT

Referring to the drawings by numerals of reference, there is shown in FIGS. 1 and 2, one embodiment of an articulated toy figure 10 in a humanoid form. It should be understood that the form shown is an illustrative example, and that various other forms may be used without departing from the scope of the invention. The articulated toy figure in accordance with the present invention is manipulated by the fingers of a human hand to reproduce lifelike human or animal movement. The articulated FIG. 10 comprises a central body or torso 11 having articulated limbs 12 such as arms 13 and legs 14. The articulated limbs 12 are rotatably or pivotally connected at 15 to the torso 11 in a conventional manner such as a ball and socket or swivel connection.

A circular ring 16 is attached to each of the appropriate limb 12 of the FIG. 10. Each ring 16 has an outer loop or ring 17 which extends outwardly from the limb to which it is attached. The outer ring or loop 17 is of sufficient dimension to slidably receive the appropriate finger of a child and each may be sized differently. Each ring 16 has an adjacent attachment ring portion 18 to be attached to the limb 12 of the articulated toy FIG. 10 as described hereinafter.

FIG. 3 shows one embodiment of the ring in the form of a ring clip 20 which may be releasably attached to the limbs 12 of the figure. The ring clip 20 comprises a length of spring wire bent in a substantial figure-eight configuration. The bent configuration forms an outer ring or loop 21 of sufficient dimension to slidably receive the appropriate finger of a child and an adjacent pair of arcuate ring attachment portions 22 to be attached to the limb 12 of the articulated toy figure. The sides of the outer ring or loop 21 are squeezed inwardly causing the arcuate ring attachment portions 22 to scissor apart as indicated in dashed line. The arcuate attachment portions are then placed around the limb 12 of the figure, and the outer ring 21 is released. In this manner, the ring clips 20 are releasably clamped to the limbs of the figure with the outer ring 21 extending outwardly to the rear of the figure.

The releasable ring clip 20 extends the play value of conventional articulated toy figures. The ring clips may be releasably attached to a conventional articulated toy figure thereby converting it to an articulated toy figure controlled by a child's finger movements and when removed, the toy figure may be played with in the conventional manner.

FIG. 4 shows another embodiment of the ring in the form of a ring 30 which may be frictionally or otherwise attached to the limbs 12 of the figure. The ring 30 comprises a single unit of metal or molded plastic material having an outer ring or loop 31 of sufficient dimension to slidably receive the appropriate finger of a child and an integral adjacent attachment ring 32 to be attached to the limb 12 of the articulated toy figure. The size of the attachment ring 32 is sufficient to be slidably received on the lower portion of the limb of the figure and moved upwardly until it becomes frictionally engaged with a larger periphery of the limb upper portion. The attachment ring 32 may also be snapped into a receiving groove provided on the limb. In this manner, the rings 30 are releasably attached to the limbs of the figure with the outer ring 31 extending outwardly to the rear of the figure.

The releasable ring 30 also extends the play value of conventional articulated toy figures as explained above. The rings 30 may also be permanently attached to a conventional articulated toy figure by applying a suitable adhesive or glue to the attachment ring 32 before inserting it over the limb.

FIG. 5 shows an embodiment of the ring which is integrally formed on the limb of the figure during the molding operation. The ring 40 comprises a single outer ring or loop 41 of sufficient dimension to slidably receive the appropriate finger of a child which is integrally molded to extend outwardly from the limb 12 of the articulated toy figure. The integrally molded ring 40, although permanently attached still allows the articulated figure to be selectively controlled by the child's fingers, or to be played with in the conventional manner.

FIG. 6 shows another releasably attached ring 50. The ring 50 comprises a single outer ring or loop 51 of sufficient dimension to slidably receive the appropriate finger of a child and which has an outwardly protruding bulbous portion or ball 52. The limbs 12 of the articulated figure are provided with apertures 53 extending through the sidewall of slightly smaller diameter than the ball portion 52. The rings 50 are releasably attached to the limbs by snapping the ball 52 into the apertures 53 to form a ball and socket type connection. To remove the rings 50, they are merely pulled out from the limbs. The embodiment of FIG. 6 allows pivotal movement of the ring relative to the limb for adapting to various hand sizes and facillitates lateral manipulation.

OPERATION

As shown in FIG. 7 using rings 30 and a humanoid figure as the examples, the rings are attached to the limbs 12 of the FIG. 10 as outlined above. The child inserts his middle finger 50 and ring finger 51 into the lowermost rings and his index finger 52 and little finger 53 into the uppermost rings. The torso or main body 11 resides close to the fingers and the limbs 12 of the figure are substantially parallel with the portion of the finger between the first and second joints When the fingers are moved, the articulated limbs of the figure will move independently of one another. With a little practice, the child can make the figure perform very realistic movements such as fighting, wrestling, running, and the like. The child also has the option of playing with the figure in the conventional manner.

The selective feature of the rings allows a child having less skill in using the hands and fingers to play with the figure in a conventional manner while learning to manipulate the figure and increase manual dexterity at his own rate without becoming frustrated in the process.

While this invention has been described fully and completely with special emphasis upon several preferred embodiments, it should be understood that within the scope of the appended claims the invention may be practiced otherwise than as specifically described herein.

We claim:

1. An improved manipulative articulated toy figure selectively convertible between use as an articulated toy figure and a figure manipulated by the fingers of a human operator for reproducing lifelike human or animal movement comprising;

a central body portion, a plurality of generally cylindrical limbs movably mounted to said central body portion and having longitudinally spaced portions of varying transverse dimension defining a circumferential ring receiving groove, a ring releasably attached to certain ones of said limbs in said ring receiving groove and positioned immediately adjacent the limb to which it is attached with the ring axis substantially parallel to the limb to which it is attached, each said ring formed of a single unit of plastic material having a circular finger receiving portion and an integral expandable semi-circular limb attachment portion contiguous and immediately adjacent the finger receiving portion to be releasably engaged in said ring receiving groove whereby said ring is releasably maintained on the limb, the circular finger receiving portion of each said ring adapted to receive the portion of a human finger between the first and second joints immediately adjacent and parallel to the limb to which said ring is attached for independent manipulation of said limbs to control the movements of the articulated figure, said central body portion of the figure being of sufficient size and proportion to be self supported on said limbs with no auxiliary support means and to reside closely adjacent to the fingers of the operator when properly positioned, said rings capable of being selectively removed from the limbs to allow manipulation of the limbs in a conventional manner when removed therefrom or selectively converted to a finger manipulated figure controlled by the fingers of a human operator when attached to said limbs, and said rings of sufficient size to allow manipulation of the limbs in a conventional manner with said rings attached and the fingers removed therefrom.

2. The improved manipulative articulated toy figure according to claim 1 wherein at least four said limbs are provided with said ring receiving groove, and the middle finger, ring finger, index finger and little finger of the operator are each received in a separate ring immediately adjacent and parallel to the limb to which said ring is attached for independent manipulation of said limbs to control the movements of the articulated figure.

3. A manipulative articulated toy figure selectively convertible between use as an articulated toy figure and a figure manipulated by the fingers of a human operator for reproducing lifelike human or animal movement comprising;

a central body portion formed of molded plastic, a plurality of generally cylindrical limbs formed of molded plastic movably mounted to said central body portion, certain ones of which have an integrally molded circular finger receiving ring portion contiguous and immediately adjacent the limb with the ring axis substantially parallel to the longitudinal axis of the limb, the circular ring portion of said certain limbs adapted to receive a human finger immediately adjacent and parallel tot he limb for independent manipulation of said limbs for controlling the movements of said certain limbs, said central body portion of the figure being of sufficient size and proportion to be self supported on said limbs with no auxiliary support mean sand to reside close to the fingers of the operator when properly positioned, and said circular ring portion being of sufficient size to allow manipulation of the limbs in a conventional manner when the fingers are removed therefrom.

4. The improved manipulative articulated toy figure according to claim 3 wherein at least four said limbs are provided with said finger receiving ring portion, and the middle finger, ring finger, index finger and little finger of the operator are each received in a separate ring portion immediately adjacent and parallel to the limb having the respective ring portion for independent manipulation of said limbs to control the movements of the articulated figure.

5. A set of finger rings to be worn on fingers of a human hand to releasably engage the limbs of articulated toy figures of the type having a central body supported on a plurality of movable limbs for independent manipulation of the movable limbs of the articulated toy figure to reproduce lifelike human or animal movement, each said finger ring formed of a single unit of resiliently deflectable material in the form of a closed loop having a circular finger receiving portion and a contiguous and integral expandable, semi-circular limb attachment portion immediately adjacent thereto, said limb attachment portion of each ring adapted to releasably engage the movable limb of the articulated toy figure, and when engaged thereon the finger receiving axis of the finger receiving portion disposed immediately adjacent and substantially parallel to the limb to which it is engaged, whereby the portion of the inserted finger between the first and second joint resides closely adjacent and parallel to the limb to which said ring is engaged for independent manipulation of said limbs to control the movements of the articulated figure, said finger ring allowing selective conversion of conventional articulated toy figures to a finger manipulated figure controlled by the fingers of a human operator when said rings are engaged on said limbs.

6. The set of finger rings according to claim 5 wherein at least four rings are provided to be worn on the middle finger, ring finger index finger and little finger of the operator respectively for independent manipulation of said limbs to control the movements of the articulated figure.

7. The combination of an articulated toy figure having movable limbs and a set of finger rings releasably attached to the limbs to receive the fingers of a human hand for independent manipulation of the movably limbs of the articulated toy figure to reproduce lifelike human or animal movement, the combination comprising;

an articulated toy figure having a central body portion and a plurality of generally cylindrical limbs movably mounted thereto and being the sole means of supporting the body portion, certain one of said limbs provided with a ring receiving portion, and a plurality of finger rings releasably carried on certain ones of said limbs, said rings formed of a single unit of resiliently deflectable material in the form of a closed loop each having a circular finger receiving portion and an integral expandable, semi-circular limb attachment portion immediately adjacent thereto, said limb attachment portion of said finger rings releasably engaged on said ring receiving portion of the movable limb with the finger receiving axis of the finger receiving portion disposed immediately adjacent and substantially parallel to the limb to which it is engaged, whereby the portion of the inserted finger between the first and second joint resides closely adjacent and parallel to the limb to which said ring is engaged for independent manipulation of said limbs, said articulated figure capable of being selectively manipulated either as a conventional articulated toy figure or as a finger manipulated figure controlled by the fingers of a human operator when said finger rings are engaged on said limbs.

8. The combination according to claim 7 wherein at least one said ring is carried on four said certain limbs, and the middle finger, ring finger, index finger and little finger of the operator are each received in a separate ring immediately adjacent and parallel to the limb to which said ring is attached for independent manipulation of said limbs to control the movements of the articulated figure.

* * * * *